US005513582A

United States Patent [19]

Antonini et al.

[11] Patent Number: 5,513,582

[45] Date of Patent: May 7, 1996

[54] INCINERATION METHOD, PARTICULARLY FOR SPENT GRAPHITE

[75] Inventors: Gérard Antonini, Paris; Olivier Lepez, Viarmes; Jean-Pierre Perotin, Vanves; Philippe Sajet, St-Sauveur, all of France

[73] Assignee: Association Gradient & Societe des Techniques en Milieu Ionisant (STMI), France

[21] Appl. No.: 420,631

[22] Filed: Apr. 12, 1995

Related U.S. Application Data

[63] Continuation of Ser. No. 178,323, filed as PCT/FR92/00659, Jul. 9, 1992, abandoned.

[30] Foreign Application Priority Data

Jul. 15, 1991 [FR] France ..... 91 08899

[51] Int. Cl.[6] ..... F23G 5/02; G21F 9/14

[52] U.S. Cl. ..... 110/238; 110/218; 110/222; 110/243

[58] Field of Search ..... 110/238, 243, 110/219, 222

[56] References Cited

U.S. PATENT DOCUMENTS

| | | | |
|---|---|---|---|
| 3,848,548 | 11/1974 | Bolejack . | |
| 4,191,115 | 3/1980 | Yang et al. | 110/218 |
| 4,486,959 | 12/1984 | Chang | 110/218 |
| 4,571,175 | 2/1986 | Bogle et al. | 432/14 |
| 4,898,107 | 2/1990 | Dickinson | 110/238 |
| 4,958,578 | 9/1990 | Houser | 110/238 |
| 5,097,774 | 3/1992 | Lauwers | 110/238 |
| 5,307,748 | 5/1994 | Khinkis et al. | 110/256 |

FOREIGN PATENT DOCUMENTS

| | | |
|---|---|---|
| 2014736 | 7/1969 | France . |
| 2318385 | 7/1975 | France . |

*Primary Examiner*—Thomas N. Moulis

*Attorney, Agent, or Firm*—Sixbey, Friedman, Leedom & Ferguson; Gerald J. Ferguson, Jr.; Jeffrey L. Costellia

[57] ABSTRACT

The method of incinerating a combustible material (1) comprises, before combustion, the following steps:

dividing (2) the material into particles, incorporating (3) the divided material into an aqueous medium at a rate of not more than 35% by weight of solid relative to the liquid, foaming and pressurizing the suspension thereby obtained, by incorporating an oxidizer gas (10) and surface-active additives (9) in a mixer (8) of the suspension.

2 Claims, 1 Drawing Sheet

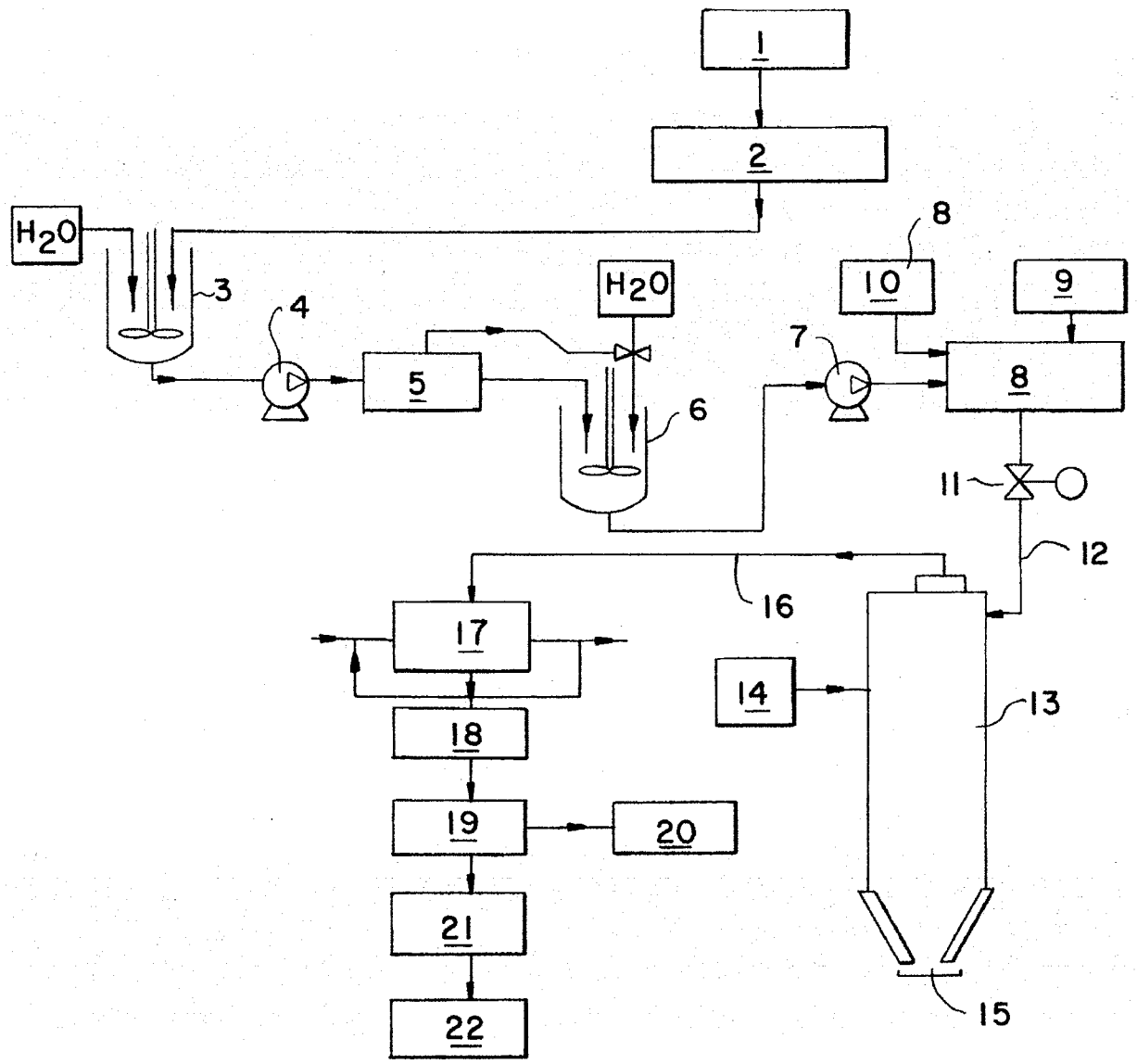
1
2
3
4
5
6
7
8
9
10
11
12
13
14
15
16
17
18
19
20
21
22
$H_2O$
$H_2O$

INCINERATION METHOD, PARTICULARLY FOR SPENT GRAPHITE

This application is a continuation of Ser. No. 08/178,323, filed as PCT/FR92/00659, Jul. 9, 1992, abandoned.

The present invention relates to a method of incinerating graphite, in particular irradiated graphite, and more generally a combustible material, such as waste, with limited production of fumes, so as to avoid significant and costly treatment thereof.

Incineration is one of the methods most often used to degrade waste. However, protection of the environment imposes increasingly severe constraints as regards discharges into the atmosphere, which gives rise to large fume treatment plants for retaining the undesirable elements and/or pollutants.

It is therefore useful to minimize fume production so as to reduce the volumes to be treated at the outlet of the incinerator.

It is also useful to avoid the production of noxious gaseous components (such as nitrogen oxides) during incineration, and one way of allowing such production to be limited is to limit the temperature of combustion.

Finally, it is advantageous to be able to provide complete combustion and to make use of a rapid reaction rate.

In order to achieve these objects, the invention proposes a method of incinerating material, including prior preparation of the material to be incinerated.

Thus, according to the invention, the method comprises, before combustion, the continuous performance of the following steps:

dividing the material into particles, incorporating the divided material into an aqueous medium to which are added foaming agents (surface-active agents) at a rate of 35% to 45% by weight of solid according to the nature of the solid concerned, increasing the pressure of the suspension thereby obtained, and foaming the suspension under pressure, by incorporating an oxidizing gas under pressure.

The oxidizing gas may be oxygen or enriched air and the pressure of the foam obtained will be of the order of 2 bars to 10 bars, as a function either of the opening of a regulating valve situated upstream of the combustion furnace, or of the pressure in the furnace and the head loss between the outlet of the pump and the combustion furnace.

The maximum amount of solid fraction (from 35% to 45% by weight of the suspension) depends on the apparent density of the crushed solid and on its lower calorific value. For example, for graphite which has high calorific value and high apparent density, the solid fraction is about 35%. For less severe criteria, the fraction may be higher without detracting from the ability of the product to be pumped and without causing combustion to take place at too high a temperature.

Other features and advantages of the invention will become apparent from the following description of an embodiment, given purely by way of example, and as applied to incinerating graphite, and in particular irradiated graphite.

It will be made with reference to the accompanying drawing in which the sole FIGURE is a diagram of the method implemented by the invention.

There currently exists a need to treat by incineration the spent and irradiated graphite originating from the dismantling of nuclear reactors. This graphite is in either of two geometric shapes, in bricks or in tubes. The nuclear quality of the material is such that it contains almost pure carbon; impurities are at very low concentrations. In order to reduce the volume of this graphite which has to be stored as waste, it has been proposed to crush it and incinerate it. It has been shown that combustion is more complete if the particles are of small diameter, if the time for which these particles reside in the furnace is significant, and if there is also significant relative speed between the gas and the solid.

In order to satisfy these conditions, a cyclone-type furnace is used, even though such a furnace is not a perfect solution to all the problems encountered in such combustion, particularly in the transportation of the solid which is divided into very fine particles, and in the generation of toxic nitrogen oxides.

Moreover, since the material to be incinerated includes radioactive particles, and since a fraction of these particles is entrained by the combustion fumes, it is absolutely essential to treat these fumes at the outlet of the incinerator, and the smaller the volume of the fumes the cheaper the treatment process.

According to the invention, the response to these constraints lies in the preparation of the fuel.

The diagram shown in the drawing illustrates a treatment and incineration line for a raw product 1, which in the present case is graphite. The first step of the treatment consists in a crushing operation 2. The crushing may consist of several stages using several types of apparatus so as to obtain at the outlet a finely-divided product of appropriate grain size (for example, 80% of the particles with a diameter less than 200μ). This crushing may be performed in a wet environment so as to avoid any escape of dust and to reduce the risks of explosion which could result therefrom, and also to obtain a fluid which is transportable by means of pumps.

Water is added in a mixer 3 to the finely divided graphite obtained at the outlet of the crushers 2. Continuous circulation of the substance issuing from the mixer is ensured using a pump 4, e.g. via a concentration detector 5 (which operates by measuring viscosity, for example) and on to a mixer 6 which adjusts the concentration by adding water. The solid particle content of the substance leaving the mixer 6 is not more than 35%. It comprises a fairly highly charged aqueous suspension which is very easily pumped. A pump 7 assists in introducing this suspension into a mixer 8 intended to produce a solid-liquid-gas three-phase mixture. This is done by introducing into the mixer, in addition to the suspension which is to be transformed into foam, surface-active additives 9 and a volume-increasing gas 10. In the present case, the gas is oxygen.

A foam pressurized in the range 2 bars to 10 bars, for example, may be obtained by means of a pressure regulating valve 11 downstream from the pump or by means of the head loss in the circuit. Pressurizing the foam provides two benefits: firstly, the foam propels itself by partial expansion in the supply ducts 12 of a combustion furnace, and secondly, the expansion of the foam in the furnace encourages its injection.

The furnace 13 is a known type of cyclone furnace which has the advantages mentioned above in relation to the time for particle transit time, and the relative speeds of the gas and the solid, so as to achieve complete combustion of the substance. Oxygen 14 is introduced into the furnace 13 as a combustion-supporting gas. It should be noted that combustion may include a post-combustion stage. The ash is received in an ashpit 15, whereas the fumes 16 are fed to a water-operated cooler 17 which allows the water vapor produced by the combustion to condense. The cooler includes a droplet eliminator which retains the water droplets. The fumes thus separated from the aqueous effluents enter a heater 18 which raises their temperature above the dew-point so as to avoid any condensation which might be detrimental to the functioning of the very high efficiency filters 19 through which the fumes pass. These filters allow the solid residues 20 to be trapped whilst the gas content of the fumes is released to atmosphere via an extractor fan and a chimney 22.

In order to illustrate the benefit of preparing the graphite in the form of a charged foam having an aqueous base (a three-phase mixture of water, oxygen, and graphite), there follows a comparison of factors between incineration carried out using known technology (for example, a fluidized bed) and incineration by means of a cyclone furnace with the fuel being introduced in the form of a foam.

| | Cyclone furnace | Fluidized bed |
|---|---|---|
| Fuel | | |
| Mass composition (%) | | |
| C | 20 | 100 |
| $H_2O$ | 80 | — |
| mass flowrate (kg/h) | 750 | 150 |
| Oxidizer | $O_2$ | air |
| mass flowrate (kg/h) | 480 | 2900 |
| Fumes | | |
| Temperature (°C.) | 1200 | 1200 |
| mass flowrate (kg/h) | 1230 | 3050 |
| mass comp. (%) | | |
| $CO_2$ | 44.7 | 18 |
| $H_2O$ | 48.8 | — |
| $N_2$ | — | 73.1 |
| $O_2$ | 6.5 | 8.9 |

It will be noted from this table that there is a reduction of 60% in the mass flowrate of fumes produced by the combustion of graphite in a cyclone furnace compared with that produced by a fluidized bed. Moreover, the fumes at the outlet of the cyclone furnace contain in practice 50% water. The fumes to be treated before release into the atmosphere are therefore 78% smaller by weight when incinerated in a cyclone furnace than when incinerated in a fluidized bed. It will be understood therefore that the filtration and purification equipment is much smaller in one technology than in the other.

From the table it is also possible to understand the benefit of initiating, firstly the formation of a foam from oxygen (even if that oxygen represents less than 4% of the oxygen required for combustion of the product), and secondly, and above all, the use of pure oxygen as oxidizer: the production of nitrogen oxides is thereby avoided.

Use of an aqueous foam greatly facilitates the control of the incineration furnace because the production of water vapor tends to reduce the temperature and regulating the solid content of the foam makes it simple to regulate the operation of the furnace, and even its shut-down in case of emergency if the combustible solid in the foam is removed completely.

Finally, it should be added that it is possible to include a relatively low fraction of polluted combustible liquid (for example a spent or contaminated oil) into the suspension before it is increased in volume.

We claim:

1. A method of incinerating a combustible material (1), characterized in that it comprises before combustion (13) the continuous performance of the following steps:

(a) dividing (2) the material into particles, (b) incorporating (3) the divided material into an aqueous medium at a maximum rate of 35% to 45% by weight of solid relative to liquid to form a suspension, (c) increasing the pressure of the suspension thereby obtained, (d) foaming the suspension under pressure, by incorporating an oxidizing gas (10) and surface-active additives (9) into said suspension in a mixer (8).

2. A method according to claim 1, characterized in that the oxidizing gas is oxygen.

* * * * *